US005225242A

United States Patent [19]

Frankosky et al.

[11] Patent Number: 5,225,242

[45] Date of Patent: Jul. 6, 1993

[54] METHOD OF MAKING A BONDED BATT WITH LOW FIBER LEAKAGE

[75] Inventors: Michael S. Frankosky; Wo K. Kwok, both of Hockessin; Donald T. Ziesel, Wilmington, all of Del.

[73] Assignee: E. I. du Pont de Nemours and Company, Wilmington, Del.

[21] Appl. No.: 800,177

[22] Filed: Nov. 27, 1991

[51] Int. Cl.[5] ..... B05D 1/02; B05D 5/00; B05D 3/12

[52] U.S. Cl. ..... 427/209; 427/389.9; 427/366

[58] Field of Search ..... 427/366

[56] References Cited

U.S. PATENT DOCUMENTS

| | | | |
|---|---|---|---|
| 2,326,605 | 8/1943 | Bass et al. | 427/366 |
| 2,454,391 | 11/1948 | Jones et al. | 427/366 |
| 3,963,820 | 6/1976 | Blakey | 264/134 |

*Primary Examiner*—Shrive Beck
*Assistant Examiner*—Erma Cameron

[57] ABSTRACT

Improved polyester fiberfill batts for apparel and other uses are prepared of polyester fiber and binder fiber, sprayed with a soft resin by oven bonding and hot roll treatment. This provides bonded batting which is characterized by softness and drapability, good insulating performance, low levels of fiber leakage or percolation through shell fabrics, enhanced durability when laundered by washing/drying or by dry cleaning, and enhanced structural integrity whereby it hangs freely without the need for quilting into small size panels.

3 Claims, No Drawings

METHOD OF MAKING A BONDED BATT WITH LOW FIBER LEAKAGE

FIELD OF THE INVENTION

This invention is concerned with improvements in and relating to bonded polyester fiberfill batts, sometimes referred to as battings, especially processes whereby such improved batts with desirable aesthetic and serviceable qualities may be obtained, and to articles incorporating such improved batts.

BACKGROUND OF THE INVENTION

Polyester fiberfill (sometimes referred to as polyester fiberfilling material) is well accepted as a reasonably inexpensive filling and/or insulating material for pillows, cushions and other furnishing materials, including bedding materials, and in apparel, and is manufactured and used in large quantities commercially. For many of these used, as disclosed e.g., in U.S. Patents: Tolliver U.S. Pat. No. 3,772,137; Stanistreet U.S. Pat. No. 4,068,036; Scott U.S. Pat. No. 4,129,675; Pamm U.S. Pat. No. 4,281,042; Frankosky U.S. Pat. No. 4,304,817; Siniscalchi U.S. Pat. No. 4,551,383; and LeVan U.S. Pat. No. 4,869,771, it has been desirable to make bonded batts, e.g., by spraying a resin-bonding agent, usually of an acrylic polymer, or by blending the polyester fiberfill with binder fibers, such as are well known in the art, or by use of both a resin-bonding agent and binder fibers.

To improve the aesthetics of polyester fiberfill, it has often proved desirable to "slicken" the fiberfill with a coating of durable (i.e., wash-resistant) coating that has usually been a silicone, i.e., a cured polysiloxane as disclosed, e.g., by Hofmann U.S. Pat. No. 3,271,189; Mead et al U.S. Pat. No. 3,454,422; Ryan U.S. Pat. No. 3,488,217; Salamon et al U.S. Pat. No. 4,146,674; LeVan, above; Takemoto Oil and Fat Co., Ltd., Japanese Published Application No. 58-214,585(1983); or other types such as the polyalkylene oxide variety disclosed by, e.g., Marcus U.S. Pat. No. 4,818,599.

Despite all the prior suggestions and commercially-available materials, especially for use in premium level apparel products, sleeping bags, and comforters, there still remains a need for an easily prepared, homogeneous batting that is characterized by softness and drapability to conform to the wearer's body, good insulating performance, low levels of fiber leakage through shell fabrics, enhanced durability to laundering by washing/drying or by dry cleaning, and enhanced structural integrity whereby the batting is able to hang freely without the need for having it quilted into small size panels.

SUMMARY OF THE INVENTION

According to one aspect of the invention, there is provided a process for preparing a bonded batt, comprising forming a blend of polyester fiberfill, in amount by weight about 70 to about 96%, intimately mixed with a binder fiber, preferably a bicomponent binder fiber, having binder material of melting point lower than the softening point of the polyester fiberfill, in amount by weight about 4 to about 30%, preparing a continuous batt from said blend, said batt having an upper face and a lower face, advancing said batt through one or more spray zones, whereby both faces of the batt are sprayed with resin, in total amount about 10 to about 30% of the weight of the sprayed batt, including the resin, said resin being selected to provide, after curing, a cured resin having a glass transition temperature (Tg) of about 0 degrees Celsius or less, heating the sprayed batt in an oven to cure the resin and soften the binder material, followed by hot-rolling the heated batt to achieve intimate contact between the resin and the fibers in the faces of the batt, and cooling the rolled batt.

The hot rolling is preferably effected by use of heated rolls in a calender or S-wrap configuration.

According to another aspect of the invention, there is provided a bonded batt, comprising polyester fiberfill of 0.2 to 10 dtex per filament, bonded throughout with lower melting binder material (from the binder fiber used in the process) in amount by weight about 2 to about 25% of the weight of the batt, and with upper and lower faces of said batt being sealed with a resin having a glass transition temperature (Tg) of about 0 degrees Celsius or less, in amount about 10 to about 30% of the weight of the batt, whereby the sealing rating (SR, as defined) of said faces is at least 3, said batt having a wash durability (WD, as defined) of at least 3, and a bending stiffness (B, as defined) of about 80 $cN/cm^2$ or less, preferably about 50 $cN/cm^2$ or less.

DETAILED DESCRIPTION OF THE INVENTION

Thus, the invention provides fiberfill batts, such as are needed for use in premium apparel, by first preparing a homogeneous blend of polyester fiberfill (70–96% by weight of the blend) and a suitable binder fiber (4–30% by weight of the blend). This blend is converted on a card or garnet to a web which may then be layered or cross lapped to form a batting to whose upper and lower faces is serially applied a suitable latex (e.g., a colloidal dispersion of acrylic polymers and/or copolymers in water, discussed in more detail hereinafter), e.g., by spraying. The sprayed batting is heated, e.g., conveniently by being passed through a heated oven to dry the coating(s) and to polymerize the polymeric component(s) to high molecular weight, and to activate the binder fiber. This may be conveniently done in three passes through such an oven, two to serially cure each coating, after such coating is applied to each face, and a third pass to supplement the other two and to activate the binder fiber in preparation for the hot-rolling. The bonded batt is passed around or through heated rolls (S-wrap or calendering process) to soften and spread the cured resin and ensure its complete and even distribution among the fibers in the two faces (large surfaces) of the batt to prevent fiber leakage through the batt and, if needed, to ensure that the batt is of the desired thickness.

The resins that may be used herein are termed variously, by different manufacturers, as "soft" or "medium", or even "very soft", but are characterized by having second order glass transition temperatures (Tg) of about 0 C or less. They provide both softness and drapability to the batt when used in, e.g., apparel, while acting as barrier to fiber leakage from the batt. The final batts may have a basis weight of 1.5 to 12 $oz./yd^2$.(50 to 400 $g./m.^2$) and a thickness of 0.07 to 0.20 $inch/oz./yd.^2$(0.05 to 0.15 $mm./g./m^2$.). Thus the batts of this invention are prepared from a blend of polyester fiberfill and binder fibers, and the fibers in the faces are sealed by a suitably soft-type resin coating. The polyester fiberfill may all be slickened, e.g., as described herein, or may be blend of slickened and unslickened fibers. The fiberfill may be solid, hollow, or a blend of solid and hollow fibers and is not limited to any type of fiber cross section, i.e., it may be of cruciform, trilobal, Y-shaped, dog bone, scalloped oval, and other non-circular cross sections as well as round. The fiberfill has a denier per filament (dpf) within the range of 0.2 to 10, with a dpf of about 1.65 being singularly preferred, and constitutes about 70 to 96% by weight of the blend. The individual fibers are provided with crimp by conventional means and typically exhibit from 5 to 15 crimps per inch and have a length within the range of ¾ to 3 inches. The binder fibers constitute from about 4 to 30% by weight of the batt and may be of the sheath/core (s/c), side/side (s/s), or monocomponent types. These may be obtained from (co)polyesters, polyolefins, polyolefin/polyester, polyamide/polyamide, e.g., and the like. Useful types of binder fibers, and their modes of functioning, are described in, e.g., "Nonwovens World", March/April, 1990, page 37. The initial dpf of suitable binder fibers in the blend is typically within the range of 2 to 15 with a dpf of 4 being commonly used. Useful binder fibers include those disclosed in the aforementioned U.S. Patents to Scott, Pamm, Frankosky, and Marcus, together with those shown in Harris et al U.S. Pat. No. 4,732,809; Taniguchi et al U.S. Pat. No. 4,789,592; Tomioka et al U.S. Pat. No. 4,500,384; Hirose et al Japanese Patent Publication Kokai 57-210,015(1982); and others known in the art which will function within the oven temperatures disclosed herein. Preferred binder fibers include the commercially-available "Melty 4080" (Unitika Co., Japan) and the "ES" and "EA" polyolefins (Chisso Corporation, Japan).

The cured resin coating on the batt constitutes about 10 to 30% by weight of the final bonded batt, with 12 to 25% being preferred, and about 18% being singularly preferred. As noted previously, a suitable resin coating has a Tg of about 0 C or less. The useful resins are obtained from commercially-available acrylic and vinyl latex compositions among which are included, e.g., Rhoplex E-32 (Rohm and Haas Co.), TR-934 (Rohm and Haas Co.), X-4280J (Kanebo, Japan), these Hycar® latex compositions of B. F. Goodrich Co.: 26146, 26171, 26322, 26083, 26092, 2671, 26120, 2679, 26796, these latex products of National Starch and Chemical Corporation: NACRYLIC X 4445, NACRYLIC X 788-6007, NACRYLIC X 4483, NACRYLIC X 4460, NACRYLIC X 4260, NACRYLIC X 4425, NACRYLIC X 4465, NACRYLIC 4401, NACRYLIC X 78-3990, NACRYLIC X 78-3997, NACRYLIC X 78-3905, NACRYLIC X 4280, NACRYLIC 4441, NACRYLIC 78-6114, X-LINK 2873, X-LINK 2849, X-LINK 78-6119, X-LINK 2893, X-LINK 2833, X-LINK 78-6004, X-LINK 2813, RESYN 2375, DUR-O-SET E-230, DUR-O-SET E-669, and other commercially-available latexes which are cured to resins whose Tg values are about 0 C or less. Some of such commercially-available resins and their Tg values are listed in brochures, e.g., one by B. F. Goodrich, dated 1989, entitled HYCAR® Acrylic Latexes, and one by National Starch and Chemical Corporation, entitled Binders, Saturants, Laminants.

Preparation of the batts is generally begun by conventional opening and blending of the polyester fiberfill and binder fiber, followed by carding or garnetting to make a web. This web can be layered with other webs from a train of cards or garnets, or it can be cross lapped and combined with other webs to form an unbonded batting. This batting is then sprayed with the latex composition on both sides of the batting and is fed to the oven for curing of the resin and bonding of the binder fibers. The oven treatment is conducted at 150–190 C for 2 to 5 minutes, and is conveniently done in three passes of the batt, as previously noted. The bonded batt is then passed through/around at least two hot rolls having a surface temperature in the range of 150 to 250 C (more than two rolls may be used). The configuration of the batting may be in S-wrap over the rolls to provide maximum contact with the rolls. The latter may have a clearance of from 2 to 5 mm. depending on the final batting thickness desired. Alternatively, the bonded batting may be passed through calender rolls, heated as above. In these treatments, only one roll may be heated, if desired, and the batt is passed through/over the rolls a second time to heat the opposite side of the batt. Contact time on the rolls is from 3 to 25 seconds. The hot roll treatment softens and spreads the resin to ensure its complete and even distribution on the batt surface(s) to prevent fiber leakage and to provide a uniform surface, free of lumps, for comfort and aesthetic performance in use. The batts exhibit the basis weight and thickness ranges previously indicated.

The batts of this invention exhibit desirable levels of thermal resistance or insulation, commonly reported as CLO ratings (see Hwang U.S. Pat. No. 4,514,455). Batts of this invention desirably exhibit a CLO value of at least about 0.36 CLO/ oz./yd.$^2$ and preferably 0.48 CLO/ oz./yd.$^2$ or higher.

It is to be understood that the components and processes described herein should be selected to provide the batts of this invention. Care must be taken to select combinations that do so provide. For example, the slickener on the fiber and the latex applied to the batt should be selected so as to adhere sufficiently, so that the final batt may exhibit, for example, sufficient wash durability.

TEST PROCEDURES

CLO ratings are obtained as described in Hwang, above.

Wash durability ("WD") of the batts of this invention is evaluated by the procedures of ASTM D-4770-88. In the Examples, the panels were 24 inches×24 inches in size. Durability ratings are reported for measurements made according to paragraph 8.6.1. Batts of the invention exhibit a rating of 3 or higher (paragraph 8.5 scale).

Fiber leakage or percolation through shell fabric is measured as a sealing rating ("SR") by the method described in LeVan U.S. Pat. No. 4,869,771, with a sealing rating (SR) of 5 being excellent and a sealing rating (SR) of 1 being poor. The batts of this invention exhibit a sealing rating (SR) of 3 or higher.

The softness or drapability of the batts of this invention is measured according to German Industrial Standard 53362 Cantilever (DIN 53362 Cantilever) which determines and totals the bending stiffness ("B") of the batting in machine and cross machine directions; the combined results are related to drapability and softness. Batting samples are cut to 25 cm. length and 2.5 cm. width, and are cut in both machine (MD) and cross machine (XD) directions. Each Test specimen is weighed and its weight recorded as "W". Bend length ("LU") is then determined by sliding the sample horizontally on a platform until the front of the bent sample reaches an angle of 41 degrees and 30 seconds. The following calculation is then made:

$$B = F_1(LU \div 2)^3$$

where B = bending stiffness in cN/cm.$^2$

LU = bend length in cm.

$F_1 = 9.8\ (W \div L)$

W = weight of the specimen sample in grams

L = sample specimen length in cm.

The batts of this invention exhibit a bending stiffness ("B" being the sum of values determined for MD and XD samples from the batt) of 80 cN/cm.$^2$ or less.

EXAMPLES

EXAMPLE 1

An 82 lb. sample of polyester staple containing 50 weight percent silicon-slickened fiber of 1.65 dpf and 2 inch cut length and 50 weight percent dry (no slickener) fiber of the same denier and cut length was opened by a conventional mechanical opener and fed to a hopper. In a separate opener was placed 18 lb. of "Melty 4080" binder fiber(4 dpf, 2 inch cut length, 50/50 s/c) which had been pre-opened. The binder fiber was fed to the same hopper containing the staple blend and the fibers were mixed, first by hand, then by mechanical tumbling of the combined actions of the inclined and horizontal aprons.

The mixed fibers were fed to two separate garnets which each produced a continuous web about 60 inches wide and having a basis weight of about 1 oz./yd.$^2$(34 g/m.$^2$). Each web was passed through a separate cross lapper which produced a cross lapped batt which was placed on a moving conveyor whose speed was about 8 yd./min(7.3 m./min.). The conveyor collected and combined both cross lapped batts into a final multiple-layered batt having a basis weight of about 2.7 oz./yd.$^2$ (90 g./m.$^2$). In a continuous operation, this batt was passed into a spray zone where Kanebo's X-4280J latex was applied to the top side of the batt which was then passed into a 3-path oven (sufficient latex was applied to provide 9% by weight cured resin on the batt). This path was at 150 C and the resin was cured and the binder fiber activated during a residence time of about 1 minute in the oven. After the batt exited the oven, it was inverted, latex applied to the top side("new") of the batt, and the batt was carried by a second conveyor to a second path of the oven (170 C) to cure the resin and activate the binder fiber (resin at 9% by weight resulted on this side of the batt to make a total of 18% by weight resin on the batt). The batting was fed to the third path of the oven (170 C) to provide further heating of the batt for an additional minute (total heating is for 3 minutes).

The bonded batt is passed through a pair of hot rolls in S-wrap configuration (roll surfaces at 200 C), with a roll contact time of about 12 seconds; roll separation was 2 mm. The batting is compressed to about one half its original thickness and is wound up into a roll. This batting (18% resin, 18% binder fiber) had a basis weight of 3.33 oz/yd.$^2$, a thickness of 0.41 inch, exhibited a wash durability rating of 4, a sealing rating of 5, and total bending stiffness of 22.1 cN/cm.$^2$ (MD = 8.6, XD = 13.5).

EXAMPLE 2

In the following Table are reported the properties of other batts of the invention, prepared by the apparatus and processes described in Example 1, above, using the same latex, oven and roll temperatures and times as in Example 1. In the Table, "Fiber A" is the fiber blend of Example 1. In all other indicated "Fibers" ("B", etc.), the binder fiber("Melty 4080") had already been combined with the fiberfill and was not separately added as shown in Example 1.

TABLE

| BATTING | | | | BASIS | | | | B | | |
|---|---|---|---|---|---|---|---|---|---|---|
| ITEM NO. | FIBER | % BINDER | % RESIN | WEIGHT (OZ/YD2) | THICKNESS (INCHES) | WD | SR | MD | CD | TOTAL |
| 1 | A | 18 | 25 | 3.14 | 0.41 | 4 | 5 | 33.5 | 35.6 | 69.1 |
| 2 | A | 25 | 18 | 2.86 | 0.35 | 4 | 5 | 20.1 | 31.1 | 51.2 |
| 3 | B | 22 | 12 | 2.76 | 0.35 | 4 | 5 | 23.1 | 38.1 | 61.2 |
| 4 | C | 15 | 18 | 3.24 | 0.31 | 5 | 5 | 14.9 | 18.8 | 33.7 |
| 5 | D | 25 | 18 | 3.08 | 0.33 | 4 | 5 | 13.2 | 34.6 | 47.8 |

Where Fiber B is a 78/22 (W/W) blend of (1) 5 dtex, solid, round cross-section, 50 mm cut length, polyethylene terephthalate staple bearing a polyalkylene oxide-slickener and (2) "Melty 4080" (4 dpf);

Fiber C is a 78/7/15 (W/W/W) blend of (1) solid, round cross-section, silicone-slickened, 3 dpf polyethylene terephthalate staple, (2) 7-hole hollow roundcross-section, silicone-slickened, 5.5 dpf polyethylene terephthalate staple, and (3) "Melty 4080" (4 dpf); and Fiber D is a 75/25 (W/W) blend of (1) 1.65 dpf solid, round cross-section, silicone-slickened, 2 inch cut length polyethylene terephthalate stapleand (2) "Melty 4080" (4 dpf).

What we claim is:

1. A method of preventing fiber leakage from a bonded batt, comprising preparing a bonded batt by forming a blend of polyester fiberfill, in amount by weight about 70 to about 96%, intimately mixed with a binder fiber having binder material of melting point lower than the softening point of the polyester fiberfill, in amount by weight about 4 to about 30%, preparing a continuous batt from said blend, said batt having an upper face and a lower face, advancing said batt through a spray zone, whereby both faces of the batt are sprayed with resin, in total amount about 10 to about 30% of the weight of the sprayed batt, including the resin, said resin being selected to provide, after curing, a cured resin having a glass transition temperature (Tg) of about 0 degrees Celsius or less, heating the sprayed batt in an oven to cure the resin and soften the binder material, followed by hot-rolling the heated batt to achieve intimate contact between the resin and the fibers in the faces of the batt, and cooling the rolled batt thereby creating a bonded batt with low fiber leakage.

2. A process according to claim 1, wherein the hot-rolling of the heated batt is effected by passing the batt between heated rolls in a calender.

3. A process according to claim 1, wherein the hot-rolling of the heated batt is effected by passing the batt around heated S-wrap rolls.

* * * * *